US007746290B2

(12) United States Patent
Skarp et al.

(10) Patent No.: US 7,746,290 B2
(45) Date of Patent: Jun. 29, 2010

(54) ADAPTIVE ANTENNA MATCHING

(75) Inventors: Filip Skarp, Lund (SE); Joakim Eriksson, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 294 days.

(21) Appl. No.: 11/854,648

(22) Filed: Sep. 13, 2007

(65) Prior Publication Data

US 2009/0073076 A1 Mar. 19, 2009

(51) Int. Cl.
*H01Q 1/50* (2006.01)

(52) U.S. Cl. ..... 343/860; 343/702; 343/751

(58) Field of Classification Search ..... 343/702, 343/751, 860, 725, 749, 895
See application file for complete search history.

(56) References Cited

U.S. PATENT DOCUMENTS 6,211,830 B1 * 4/2001 Monma et al. ..... 343/702
6,697,030 B2 * 2/2004 Gleener ..... 343/860
7,260,424 B2 * 8/2007 Schmidt ..... 455/575.7
7,277,677 B2 * 10/2007 Ida et al. ..... 455/78
2007/0197180 A1 8/2007 McKinzie, III et al.
2007/0285326 A1 12/2007 McKinzie

FOREIGN PATENT DOCUMENTS

EP 1 653 611 A1 5/2006
EP 1 655 850 A1 5/2006
GB 2 330 965 A 5/1999

OTHER PUBLICATIONS

International Search Report for PCT/EP2007/064027 mailed May 19, 2008, 3 pages.

* cited by examiner

*Primary Examiner*—Douglas W Owens
*Assistant Examiner*—Chuc D Tran
(74) *Attorney, Agent, or Firm*—Harrity & Harrity, LLP

(57) ABSTRACT

The present invention relates to a portable communication device and a method of controlling the matching of an antenna in a portable communication device. The device may include an antenna; a radio circuit to send a radio frequency signal to the antenna via a signal path; a matching network including a number of network components and configured to be in the signal path; a detector configured to detect an electromagnetic field from the antenna; and a control unit configured to control matching of the antenna by influencing at least one of the first matching network or the antenna based on the detected electromagnetic field.

17 Claims, 3 Drawing Sheets

ADAPTIVE ANTENNA MATCHING

TECHNICAL FIELD OF THE INVENTION

The present invention relates to antennas and, more particularly, to a portable communication device including an antenna as well as to a method of controlling the operation of the antenna.

DESCRIPTION OF RELATED ART

Electronic devices, such as communication device (e.g., cellular phones), are becoming increasingly smaller. At the same time, however, the performance capabilities of the device must be maintained or improved. One component in such phones for which the performance is heavily dependent on size is the antenna. Thus when sizes get smaller the performance of the antenna may therefore be degraded. The situation may furthermore get worse by obstacles in the immediate environment of a phone. Such obstacles may, for instance, be the fingers or hand of a user, the head of a user or other objects like a table or a pocket on which or in which the phone may be placed. Such situations may lead to dropped phone calls and a generally substandard performance of a phone.

There is therefore a need for improving on this situation.

SUMMARY OF THE INVENTION

A first aspect of the present invention is directed towards a portable communication device that includes an antenna; a radio circuit feeding the antenna with a radio frequency signal; a first matching network including a number of network components and provided in a signal path between the antenna and the radio circuit; a detector configured to detect the electromagnetic field radiated by the antenna; and a control unit configured to control the matching of the antenna through influencing the matching network and/or the antenna based on the detected field for improving the performance of the antenna.

A second aspect of the present invention is directed towards a portable communication device including the features of the first aspect, wherein the control unit when influencing the matching network is configured to connect one or more further components into the signal path.

A third aspect of the present invention is directed towards a portable communication device including the features of the first aspect, wherein at least one component in the signal path is variable and the control unit when influencing the matching network is configured to change the magnitude of at least one such variable component.

A fourth aspect of the present invention is directed towards a portable communication device including the features of the first aspect, wherein there is a second matching network and the control unit when controlling the matching is configured to switch the second matching network into the signal path between the radio circuit and antenna instead of the first matching network.

A fifth aspect of the present invention is directed towards a portable communication device including the features of the first aspect, wherein the matching network includes a strip line and the control unit when influencing the matching network is configured to change the phase of the radio frequency signal through influencing the strip line.

A sixth aspect of the present invention is directed towards a portable communication device including the features of the fifth aspect, wherein the control unit when influencing the strip line is configured to connect the strip line into the signal path between the radio circuit and the antenna.

A seventh aspect of the present invention is directed towards a portable communication device including the features of the fifth aspect, wherein the strip line is provided in the signal path between the radio circuit and the antenna and the control unit when influencing the strip line is configured to change the length of the strip line.

An eighth aspect of the present invention is directed towards a portable communication device including the features of the first aspect, wherein the control unit when controlling the matching is configured to compare data indicative of the detected field with a set of pre-stored reference data indicative of fields relating to a number of known antenna use cases, select a matching strategy associated with pre-stored reference data that best matches the data indicative of the detected field and control the matching according to the selected strategy.

A ninth aspect of the present invention is directed towards a portable communication device including the features of the eighth aspect, wherein the use cases include use cases in the group of: fingers placed over the antenna, a head being placed to the device, device being placed in a pocket, device being placed on a surface and device being positioned in free space.

A tenth aspect of the present invention is directed towards a portable communication device including the features of the first aspect, in which it is a cellular phone.

An eleventh aspect of the present invention is directed towards a method of controlling, in a portable communication device, the matching of an antenna being fed with a radio frequency signal by a radio circuit, where a first matching network comprising a number of network components is provided in a signal path between the antenna and the radio circuit, the method including detecting the electromagnetic field radiated by the antenna, and controlling the matching of the antenna through influencing the matching network and/or the antenna based on the detected field for improving the performance of the antenna.

A twelfth aspect of the present invention is directed towards a method including the features of the eleventh aspect, wherein the influencing of the matching network comprises connecting one or more further components into the signal path.

A thirteenth aspect of the present invention is directed towards a method including the features of the eleventh aspect, wherein at least one component in the signal path is variable and the influencing of the matching network comprises changing the magnitude of at least one such variable component.

A fourteenth aspect of the present invention is directed towards a method including the features of the eleventh aspect, wherein the step of controlling the matching comprises switching a second matching network into the signal path between the radio circuit and antenna instead of the first matching network.

A fifteenth aspect of the present invention is directed towards a method including the features of the eleventh aspect, wherein the matching network includes a strip line and the influencing of the matching network includes changing the phase of the radio frequency signal through influencing the strip line.

A sixteenth aspect of the present invention is directed towards a method including the features of the fifteenth aspect, wherein the influencing of the strip line includes connecting the strip line into the signal path between the radio circuit and the antenna.

A seventeenth aspect of the present invention is directed towards a method including the features of the fifteenth aspect, wherein the strip line is provided in the signal path between the radio circuit and the antenna and the influencing of the strip line includes changing the length of the strip line.

An eighteenth aspect of the present invention is directed towards a method including the features of the eleventh aspect, wherein the step of controlling the matching includes comparing data indicative of the detected field with a set of pre-stored reference data indicative of fields relating to a number of known antenna use cases, selecting a matching strategy associated with pre-stored reference data that best matches the data indicative of the detected field and controlling the matching according to the selected strategy.

A nineteenth aspect of the present invention is directed towards a method including the features of the eighteenth aspect, wherein the use cases include use cases in the group of: fingers placed over the antenna, a head being placed to the device, device being placed in a pocket, device being placed on a surface and device being positioned in free space.

Implementations of the invention provide at least the advantage of provision of good antenna performance even though the antenna is not dimensioned for optimal performance under the circumstances in which it may be being operated. The invention thus allows the obtaining of good performance for small antennas in small portable communication devices. The antenna can be adapted for functioning better under virtually all circumstances. This change is furthermore done adaptively and automatically. A user of the device need not get involved. The invention is furthermore simple and cheap to implement, since it involves a limited number of additional elements.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION

An exemplary portable communication device according to the invention will now be described in relation to a cellular phone, which is a preferred variation of the invention. The portable communication device can be based on another type of device though, like a cordless phone, a PDA, a palm top computer or any other type of portable device communicating that uses radio waves.

Figure 1:
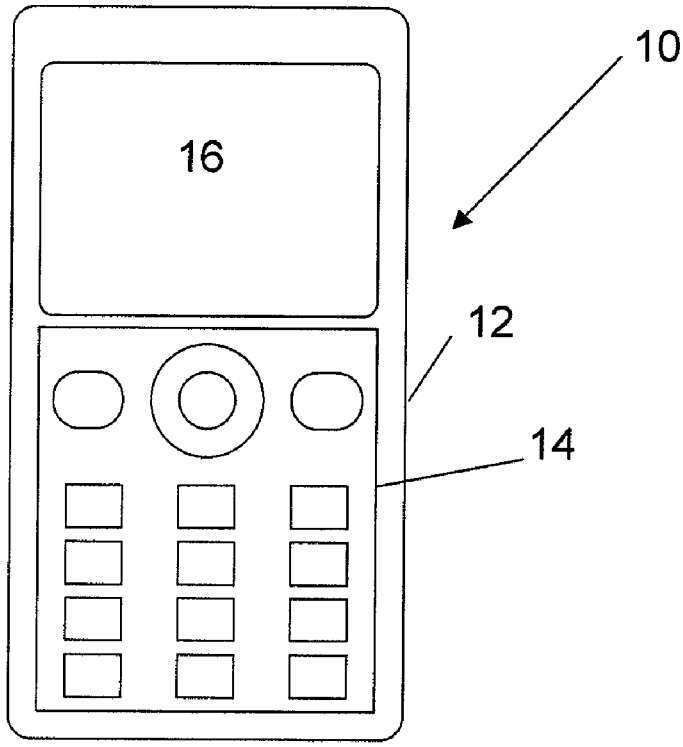
FIG. 1 schematically shows a front view of a cellular phone according to the invention.

FIG. 1 schematically shows a front view of a phone 10. Phone 10 includes a keypad 14 and a display 16, both of which may provide user interfaces via a casing 12 of phone 10. The casing 12 then typically includes a window, below which the display 16 is provided and openings through which the keys of a keypad 14 may protrude. In the figure, the keypad 14 can be seen as provided in a bottom part of the casing 12, while the display 16 is provided in an upper part.

Figure 2:
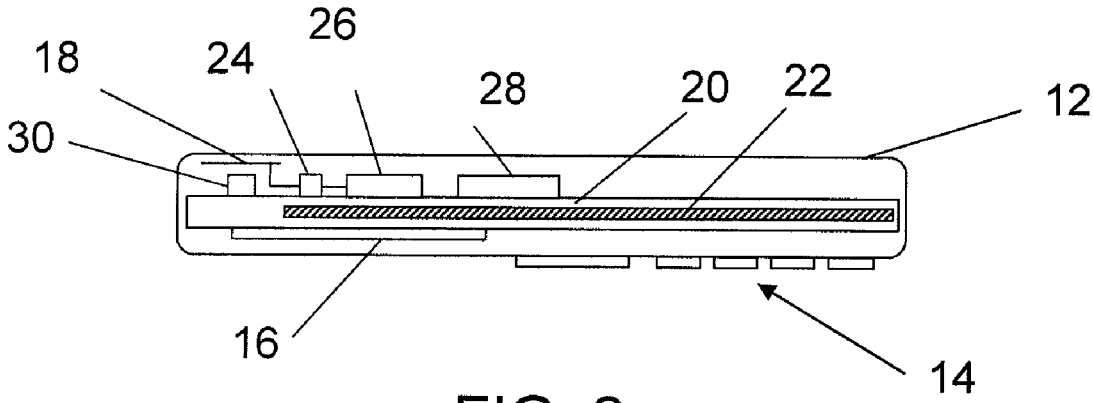
FIG. 2 schematically shows a side view of the interior of a phone of FIG. 1 and comprising a circuit board inside a casing, on which board elements relating to the present invention are placed.

FIG. 2 shows a side view of the phone in FIG. 1 and some elements of it provided inside the casing 12. A front of the casing 12, which is directed downwards in the drawing includes the above mentioned display window (not shown) and the keypad 14. The opposite side of the casing 12, which is facing upwards in the drawing, then makes up the back of the casing.

In FIG. 2 there is also shown some of the elements of the present invention that are placed inside the casing 12. The casing 12 encloses a circuit board 20 on which some elements are placed. On one side of the circuit board 22, a front side that is intended to face the front of the casing, there is provided a display 16, while on the back side of the circuit board 20 there is provided a first matching network 24 electrically connected between an antenna 18 and a radio circuit 26. The back side of the board 20 is intended to face the back of the casing 12. The first matching network 24 is connected in a signal path provided between the radio circuit 26 and the antenna 18. The antenna 18 is normally provided on a distance above the circuit board 20 in the upper part of the phone close to the back of the casing 12. However, it should be realized that the placing of the antenna 18 is not central to the present invention. On the back side of the circuit board 20 there is furthermore provided a control unit 28 and a detector 30. The detector 30, which in this embodiment is provided as a Hall element, is placed on the circuit board 20 beneath the antenna 18. In the middle of the circuit board 20 there is provided a ground plane 22 that here stretches throughout most of the circuit board 20. The ground plane 22 does here not stretch up to the area of the circuit board 20 above which the antenna 18 is placed, although it may do so in some variations of the present invention. It should here be realized that the side of the circuit board 20 that the matching network 24, the radio circuit 26, control unit 28 and the detector 30 are placed on is not crucial for the present invention, but that some or all of them could just as well be placed on the other side. The detector 30 may furthermore have essentially any placing in the phone as long as the ground plane 22 is not placed between it and the antenna 18.

Figure 3:
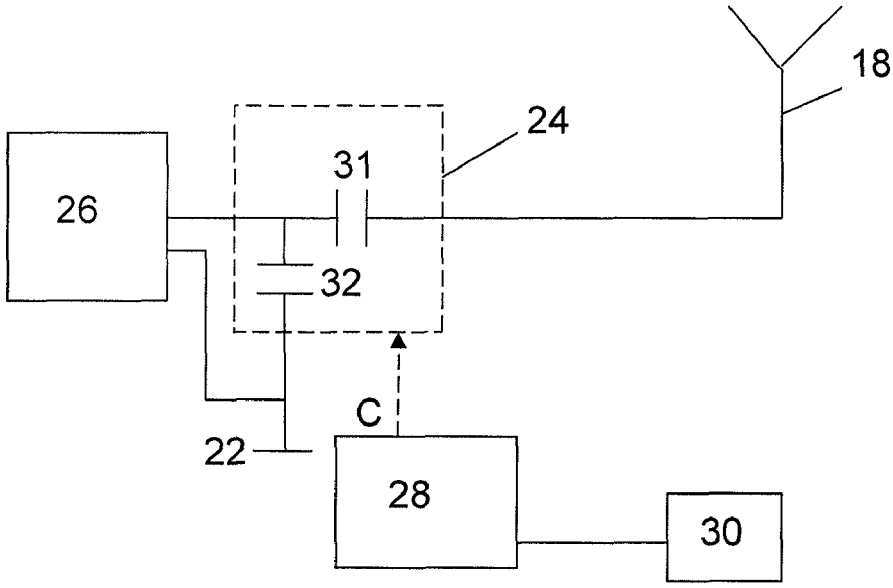
FIG. 3 shows a block schematic of various elements in the interior of a phone according to a first embodiment of the present invention.

FIG. 3 shows a block schematic of various elements in the interior of the phone according to a first embodiment of the present invention. The first matching network 24 includes a number of components provided in the signal path between the radio circuit 26 and the antenna 18. These components are in the first embodiment capacitors, which are here limited to two for simplicity. There can of course be several more components in the matching network 24. The antenna 18 is thus here connected to a first end of a first capacitor 31 of the first matching network 24, while a second end of said first capacitor 31 is connected to a first end of a second capacitor 32 and to the radio circuit 26. A second end of the second capacitor 32 is here connected to ground 22 as is the radio circuit 26. The detector 30, which was placed directly below the antenna 18 in FIG. 2, is furthermore connected to the control unit 28, which in turn is configured to control the matching of the antenna 18. The control of the antenna matching is here provided through influencing the first matching network 24. In this embodiment the influence is furthermore provided through controlling the first matching network 24. This control is in FIG. 3 indicated by a dashed arrow denoted C. The matching network 24 is in the shown embodiment a CC circuit that is implemented with capacitors, where at least one is variable, i.e. it has a magnitude that may be controlled by the control unit 28 in order to match the antenna 18 to various frequencies. However other components can be used instead or in combination with capacitors, like inductors and strip lines.

Figure 4:
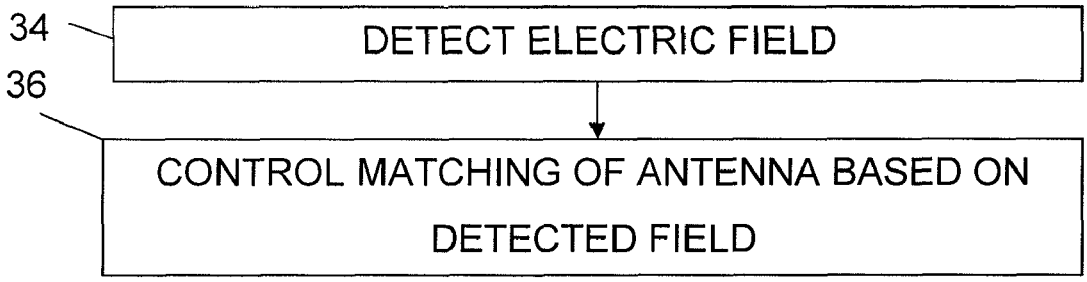
FIG. 4, shows a flow chart of a number of method steps in a general method according to the present invention.

The front that was mentioned in relation to FIG. 2 is in a first use case intended to face a user, i.e., to be placed against the head of a user when the phone is being used in for instance making and receiving phone calls. Thus in this use case the upper part is directed upwards into the air while the bottom part is facing downward towards the ground if the phone is used by a user standing up. For the same reason the back of the casing is often intended to face away from the user. However the phone can have other use cases. The hand of a user may be placed over the phone, the phone may be placed in a pocket or a suitcase or the pocket may be placed on a table. The phone may also be held in free space without the restrictions of the above mentioned use cases. All these various use cases influence the performance of the antenna. This influence is furthermore in many cases a negative influence. The present invention is directed towards improving the antenna performance in various situations, like for instance in relation to such use cases. The functioning of the phone according to the first embodiment will now be described with reference also being made to FIG. 4, which shows a flow chart of a number of method steps in a general method according to the present invention.

In operation, for instance when receiving or making telephone calls, the radio circuit 26 generates radio frequency (RF) signals that are to be transmitted by the antenna 18. The components of the matching network 24 may here initially have some default or initial settings that are applied. The radio frequency signals are thus provided from the radio circuit 26 via the matching network 24 to the antenna 18, which transmits them over the air.

As this is done the detector 30 detects 5 the electromagnetic field that the antenna 18 radiates. In this embodiment it detects the electric E-field of this electromagnetic field, step 34. Since the detector 30 may here be a Hall element it may provide a voltage that is indicative of the detected E-field. The detector 30 therefore provides data, here in the form of a voltage signal, which is indicative of the detected E-field. This data is then sent from the detector 30 to the control unit 28. Based on the detected E-field and more particularly based on data indicative of this detected E-field the control unit 28 then controls the matching of the antenna 18, step 36. This may according to the first embodiment of the present invention be done through changing the magnitude of at least one of the variable components, for instance one or more of the capacitors 31 and 32. It is here possible that this changing is done continuously or in a number of steps until a sufficiently good antenna performance is obtained. A sufficient performance can here be determined to exist based on the E-field detected by the detector 30 after one or more changes of the magnitude of a capacitor.

As one of many alternatives it is here possible to provide a discrete control. One way of providing a discrete control is to include one or more components in the matching network that are initially disconnected from the signal path or are initially not having an influence on the matching. Based on the detecting of the electrical field being unsatisfactory, it is then possible to connect this/these additional components into the signal path in order to change the matching. Thus here the first matching network is influenced through switching in one or more components are provided in this matching network into the signal path. In this case it is possible that the components are fixed and not variable. Here it should also be realized that it is possible to combine also with variable components and thus this switching in of one or more additional components may be combined with the changing of the magnitude of one or more variable components, either the ones that were originally provided in the path and/or the ones being switched into the path.

Figure 5:
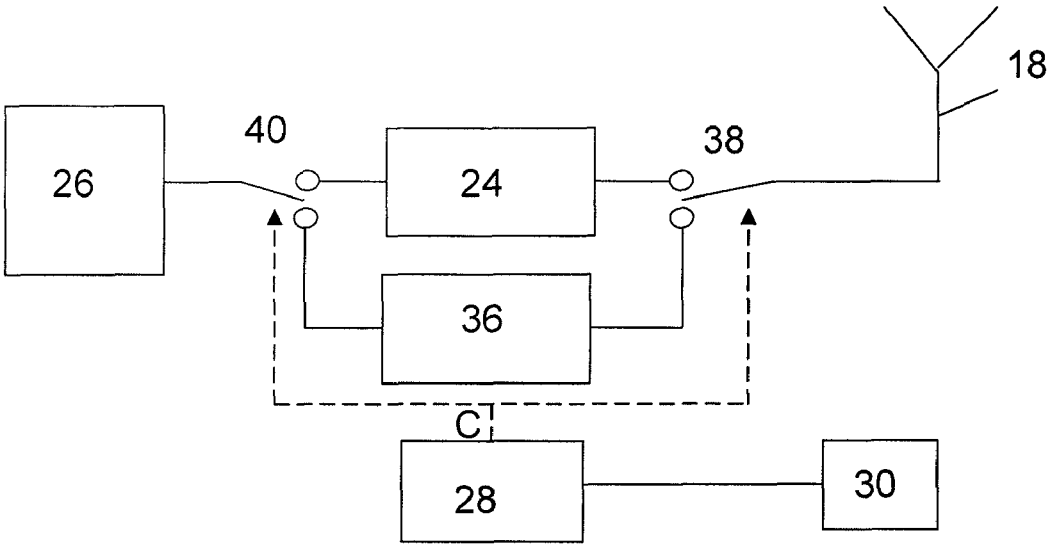
FIG. 5 shows a block schematic of various elements in the interior of a phone according to a second embodiment of the present invention.

Another way in which this discrete change in matching may be performed will now be described in relation to FIG. 5, which shows a block schematic of some elements in the interior of a phone according to a second embodiment of the present invention. FIG. 5 differs from FIG. 3 in that in the signal path between the radio circuit 26 and the antenna 18 there are provide a first and a second switch 38 and 40 provided on opposite sides of the first matching network 24, which switches are configured to disconnect the first matching network 24 from the signal path and instead connected a second matching network 36 into the signal path based on a control signal C from the control unit 28. The components of the first matching network 24 are furthermore not shown in this figure. According to this variation of the invention the first matching network 24 is influenced through the second matching network 36 being switched into the signal path instead of the first matching network 24 in dependence of the detected E-field. This can for instance be done if the data indicative of the detected E-field exceeds a certain threshold.

Here it should be realized that it is possible to provide more matching networks that get switched into the signal path, for instance based on various thresholds being exceeded. It is furthermore possible that as one of the options no matching network is switched in but that the radio circuit is directly connected to the antenna. This switching in of a second matching network may furthermore with advantage be combined with also changing the magnitude of a component of the second matching network and/or switching in of a component in the second matching network. Also the first matching network may here also receive the above mentioned changes before being replaced by the second matching network.

Figure 6:
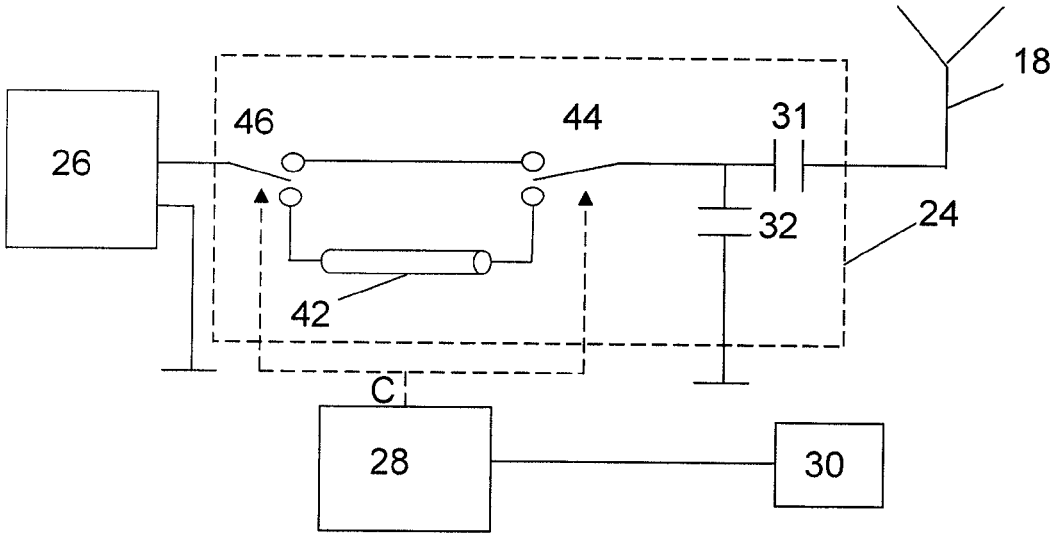
FIG. 6 shows a block schematic of a number of elements in the interior of a phone according to a third embodiment of the present invention.

A further variation of the present invention in which a discrete change in matching may be performed will now be described in relation to FIG. 6, which shows a block schematic of some elements in the interior of a phone according to a third embodiment of the present invention. The difference in relation to FIG. 3 is that here there is a third and a fourth switch 44 and 46 that are connected in the signal path between the radio circuit 26 and the antenna 18. These switches 44 and 46 are controlled by the control unit 28 to selectively switch in a strip line 42 into the signal path. In this way the phase of the radio frequency signal sent from the radio circuit 26 to the antenna 18 is changed in order to control the matching of the antenna 18. The strip line 42 is here a part of the first matching network 24. However it should be realized that the strip line 42 may also be separate from the first matching network 24.

As an alternative to this or in addition, it is furthermore possible that the length of such a strip line is changed by the control unit. In this case the strip line may be provided in the signal path all the time or the change of the length may be provided on a strip line that is switched into the signal path along with what is suggested in FIG. 6. The change of the length may be obtained through interconnecting various strip line elements with each other. This may with advantage also be combined with any of the previously described ways of influenced the matching. The strip line may furthermore also be provided in the second matching network that was described as being switched into the signal path in the second embodiment.

Figure 7:
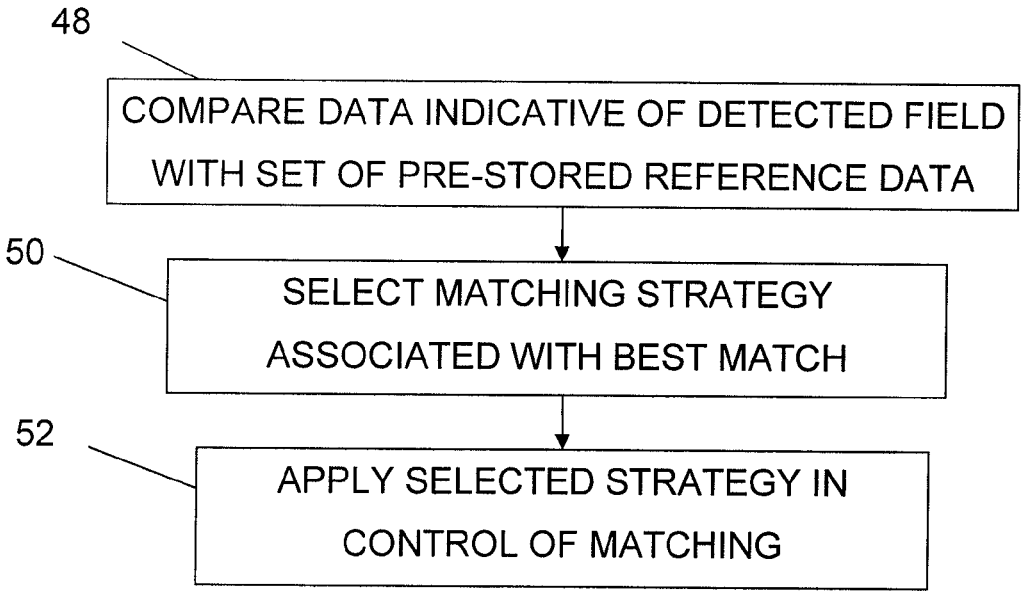
FIG. 7 shows a flow chart of a number of further method steps that can be provided in a variation of the method according to the present invention.

Finally a further variation of the present invention for influencing the matching that can use any of the above ways of controlling various elements of matching networks and strip lines is being described with reference being made to FIG. 7, which shows a flow chart of a number of further method steps that can be provided in a variation of the method according to the present invention.

In this case a number of measurements have been made beforehand for the performance of the antenna in relation to a number of uses cases. This can typically have been made in a laboratory for these various cases, such as for the cases the hand or fingers being placed over the antenna, the phone being held to the head, the phone being placed in pocket or a suitcase, the phone being placed on an even surface, with the front facing up or with the front facing down or the phone being used in free space. Reference data indicative of the electric E-field for one or more of these use cases are then pre-stored in the control unit or in an associated memory. It is furthermore possible that a matching strategy comprising at least one adjustment that would give a better antenna performance is provided for each such use case. A strategy could then include settings for the first matching network, for switching in components in the first matching network or for switching in of a further matching network, perhaps with further settings for this network, which would improve the antenna performance and perhaps obtain the best antenna performance that it is possible for the use case. It is here possible that the settings have been determined beforehand by laboratory tests in relation to the use cases and then stored in the control unit or the corresponding memory. The settings can then involve a setting that provides any of the previously described changes for improving the matching, like changing the magnitude of a variable component and/or switching in of components, additional matching networks or strip lines etc. There would thus be one matching strategy for each such use case.

As the phone is then put to use and the electric E-field is detected and data indicative of this detected field is sent to the control unit, the control unit then compares the data indicative of the detected field with pre-stored reference data indicative of E-fields associated with various use cases, step 48. The control unit then goes on and selects a matching strategy to be used for matching the antenna, step 50. The strategy it selects is here the strategy that is associated with a use case having an E-field that is closest to the E-field presently detected. Thereafter the control unit 28 goes on and applies the selected strategy in controlling the matching, step 52. This is then done through applying the settings associated with the strategy.

As an alternative to having pre-stored settings, it is possible that settings for a use case are changed stepwise or continuously until a sufficient performance is detected. These settings are then stored and later applied directly for the use case in question.

It is here possible that there is a set of reference data corresponding to several E-fields for each use case. Reference data for the comparison are then provided for E-fields that have been measured for different settings that influence the first matching network. There may thus be one E-field for a nominal or default setting as well as an E-field for each possible change or setting that has been made to the matching in relation to the other use cases. In the use case of hands on the phone, the reference data for this use case would then include data about the E-field in a nominal or default situation when no changes have been made of the matching as well as when the matching network had the settings associated with other use cases, like the settings that could have been made for hands placed over the antenna or the settings made for phone in pocket, on table etc. In this way it is possible to continuously change the matching based on the various use cases and also to correctly identify which use case is applicable.

The radio circuit can be provided in an ASIC circuit which provides mobile cellular radio communication functions. The control unit may be provided as a processor with an associated program memory comprising computer program code, which code when loaded into the processor performs the various method steps of the method according to the present invention. The antenna can be any suitable antenna including a dipole, monopole and PIFA antenna.

The device according to the present invention has a number of advantages. It enables the provision of good antenna performance even though the antenna is not dimensioned for best performance under the circumstances it is being operated. The invention thus allows the obtaining of good performance for small antennas in small portable communication devices. The antenna can be adapted for functioning better under virtually all circumstances. This change is furthermore done adaptively and automatically. A user of the device need not get involved. The invention is furthermore simple and cheap to implement, since it involves a limited number of additional elements. According to some variations of the present invention special consideration is taken for a number of use cases. For these use cases the best change of matching can then in most cases be made directly through directly applying the appropriate settings.

Previously various influences of the matching network were described. As an alternative it is possible to control the matching through influencing the antenna instead, which may be done through for instance changing the length of the antenna. The detector was above described as detecting the electric field of the antenna. It may as an alternative detect the magnetic B-field instead. It should also be realized that matching networks may be provided with the use of inductors as well, either instead of or combined with capacitors. There may furthermore be provided more than one detector. This may be done in order to make sure that detection is not made in a position where the field is weakest. The invention is therefore only to be limited by the accompanying claims.

What is claimed is:

1. A portable communication device comprising:

an antenna;

a radio circuit to send a radio frequency signal to the antenna via a signal path;

a first matching network including a number of network components and configured to be in the signal path;

a detector configured to detect an electromagnetic field from the antenna; and a control unit configured to control matching of the antenna by influencing at least one of the first matching network or the antenna based on the detected electromagnetic field, where when controlling the matching, the control unit is to:

compare data indicative of the detected electromagnetic field to a set of pre-stored reference data indicative of fields relating to a number of known parameters associated with different conditions of antenna use, select a matching strategy associated with a portion of the pre-stored reference data based on the data indicative of the detected electromagnetic field, and control the matching of the antenna based on the selected strategy.

2. The portable communication device of claim 1, wherein when influencing the first matching network the control unit is configured to connect one or more of the network components into the signal path.

3. The portable communication device of claim 1, wherein at least one of the network components is variable, and when influencing the first matching network the control unit is configured to change a magnitude of the at least variable component.

4. The portable communication device of claim 1, further comprising:

a second matching network, wherein when controlling the matching the control unit is configured to switch from the first matching network to the second matching network in the signal path.

5. The portable communication device of claim 1, wherein the first matching network includes a strip line, and when influencing the first matching network the control unit is configured to change a phase of a radio frequency signal by influencing the strip line.

6. The portable communication device of claim 5, wherein when influencing the strip line the control unit is configured to connect the strip line into the signal path.

7. The portable communication device of claim 5, wherein the strip line is disposed in the signal path, and when influencing the strip line the control unit is configured to change a length of the strip line.

8. The portable communication device of claim 1, wherein the different conditions of antenna use include at least one of fingers of a user contacting the antenna, a head of the user contacting the portable communication device, the portable communication device being disposed in clothing of the user, the portable communication device being disposed on a surface, or the portable communication device being disposed in free space.

9. The portable communication device of claim 1, wherein the portable communication device is a cellular phone.

10. In a portable communication device, a method comprising:

detecting a electromagnetic field associated with an antenna configured to receive a radio frequency signal from a radio circuit, wherein a first matching network that includes a number of network components is configured to be operably disposed in a signal path between the antenna and the radio circuit; and controlling a matching of the antenna by influencing at least one of the first matching network or the antenna based on the detected electromagnetic field, where the controlling the matching comprises:

comparing data indicative of the detected electromagnetic field to a set of pre-stored reference data indicative of fields relating to a number of known parameters associated with different conditions of antenna use, selecting a matching strategy associated with a portion of the pre-stored reference data based on the data indicative of the detected electromagnetic field, and controlling the matching of the antenna based on the selected strategy.

11. The method of claim 10, wherein the influencing of the first matching network comprises connecting one or more components into the signal path.

12. The method of claim 10, wherein at least one of the network components is variable, and the influencing the first matching network comprises changing a magnitude of the at least one variable network component.

13. The method of claim 10, wherein the controlling the matching comprises switching, from the first matching network, a second matching network into the signal path.

14. The method of claim 10, wherein the first matching network includes a strip line, and the influencing the first matching network comprises changing a phase of a radio frequency signal by influencing the strip line.

15. The method of claim 14, wherein the influencing the strip line comprises connecting the strip line into the signal path between the radio circuit and the antenna.

16. The method of claim 14, wherein the strip line is disposed in the signal path, and the influencing the strip line comprises changing a length of the strip line.

17. The method of claim 10, wherein the different conditions of antenna use include at least one of fingers of a user contacting the antenna, a head of the user contacting the portable communication device, the portable communication device being disposed in clothing of the user, the portable communication device being disposed on a surface, or the portable communication device being disposed in free space.

* * * * *